United States Patent [19]

Schenkel

[11] Patent Number: 5,025,246

[45] Date of Patent: Jun. 18, 1991

[54] EAS TAG WITH MOTION DETECTION FACILITY

[75] Inventor: Howard M. Schenkel, Boca Raton, Fla.

[73] Assignee: Sensormatic Electronics Corporation, Deerfield Beach, Fla.

[21] Appl. No.: 507,655

[22] Filed: Apr. 10, 1990

[51] Int. Cl.[5] ..... G08B 13/14; H01H 35/02

[52] U.S. Cl. ..... 340/572; 200/61.45 R; 340/693

[58] Field of Search ..... 340/572, 568, 693, 689, 340/669, 309.15, 825.65; 33/366; 200/DIG. 29, 61.45 R

[56] References Cited

U.S. PATENT DOCUMENTS

| | | | |
|---|---|---|---|
| 3,988,724 | 10/1976 | Anderson | 340/572 X |
| 4,567,473 | 1/1986 | Lichtblau | 340/572 |
| 4,686,513 | 8/1987 | Farrar et al. | 340/572 |
| 4,797,659 | 1/1989 | Larsen | 340/572 |

*Primary Examiner*—Glen R. Swann, III
*Assistant Examiner*—Thomas J. Mullen, Jr.
*Attorney, Agent, or Firm*—Robin, Blecker, Daley & Driscoll

[57] ABSTRACT

An electrical article surveillance (EAS) tag is inclusive of an electrical power source contained with the tag and circuitry powered by the electrical power source and a motion sensor operatively associated with the tag and contained therewith, the motion sensor providing output indication of movement and thereupon effecting loading of the electrical power source by such tag circuitry.

27 Claims, 4 Drawing Sheets

EAS TAG WITH MOTION DETECTION FACILITY

FIELD OF THE INVENTION

This invention relates generally to electronic article surveillance (EAS) systems and practices and pertains more particularly to improved EAS tags of the so-called "active" type, i.e., involving self-powering, such as by a contained battery.

BACKGROUND OF THE INVENTION

Whereas EAS tags are typically of a "passive" type, i.e., do not carry therewith a source of power but rather, respond to incident energy to reradiate the same or a permutation thereof, there are known EAS tags which are of "active" type, carrying therewith a battery or like source of electrical power. Advantage attends the on-board, self-powering capacity, since the tag can thereby be of the so-called "smart" or "intelligent" variety, such as is disclosed in commonly-assigned U.S. Pat. No. 4,686,513, which is incorporated herein by this reference thereto.

The tag of the '513 patent, by reason of its on-board power supply, has capacity for processing coded, received messages to assume responsive diverse states and to exhibit different operational characteristics corresponding with such states, thereby expanding the operational states of the tag as contrasted with the passive-type tags.

One concern attending active tags is that of power source conservation and measures are known to address this concern. A version of commercial tag of the common assignee, Sensormatic Electronics Corporation, thus included, as a part of the printed circuit board (PCB), which incorporates circuitry related to received message decoding and tag state assignment, electrically conductive traces adapted to be interconnected by movement of an electrically conductive member upon tag orientation change. Thus, one of the states of the '513 patent tag is "Sleep", wherein its circuitry is dormant, conserving battery life. On movement of the article to which the tag is attached, the intention of the commercial tag under discussion was to "re-awaken" on interconnection of the electrical traces by movement of the electrically conductive member. To the extent that movement of the tag did not insure certainty of such trace interconnections, this prior art arrangement was not as effective as desired in preserving power source integrity while at the same time re-awakening tags, i.e., rendering the tag electrical circuitry active.

SUMMARY OF THE INVENTION

The present invention has as its primary object the provision of improved EAS tags of the active type.

It is a more particular object of the invention to provide for enhanced battery life conservation protection in EAS tags of the active type and enhanced re-awakening capability.

In attaining the foregoing and other objects, the present invention provides in combination:

(a) an EAS tag inclusive of an electrical power source contained with the tag and circuitry powered by the electrical power source; and (b) a motion sensor operatively associated with the tag and contained therewith, the motion sensor providing output indication of movement and thereupon effecting loading of the the electrical power source by such tag circuitry.

The motion sensor comprises first and second housings of electrically conductive material, first and second electrically conductive elements movably supported respectively in the first and second housings, and a joinder member for mechanical interconnection of the first and second housings, the joinder member being comprised of electrically insulative material to electrically isolate the housings from one another and defining a passage permitting movement of the first and second electrically conductive means between the first and second housings responsively to orientation of the tag.

The joinder member, the housings and the first and second electrically conductive elements are collectively dimensioned to provide for electrical conductivity between the first and second housings upon reorientation of the tag from a disposition wherein neither of the first and second electrically conductive elements is in registry with the joinder member to other disposition.

The foregoing and other objects and features of the invention will be further understood from the following detailed description of preferred embodiments thereof and from the drawings wherein like reference numerals identify like components and parts throughout.

DESCRIPTION OF THE PREFERRED EMBODIMENTS AND PRACTICES

Figure 1:
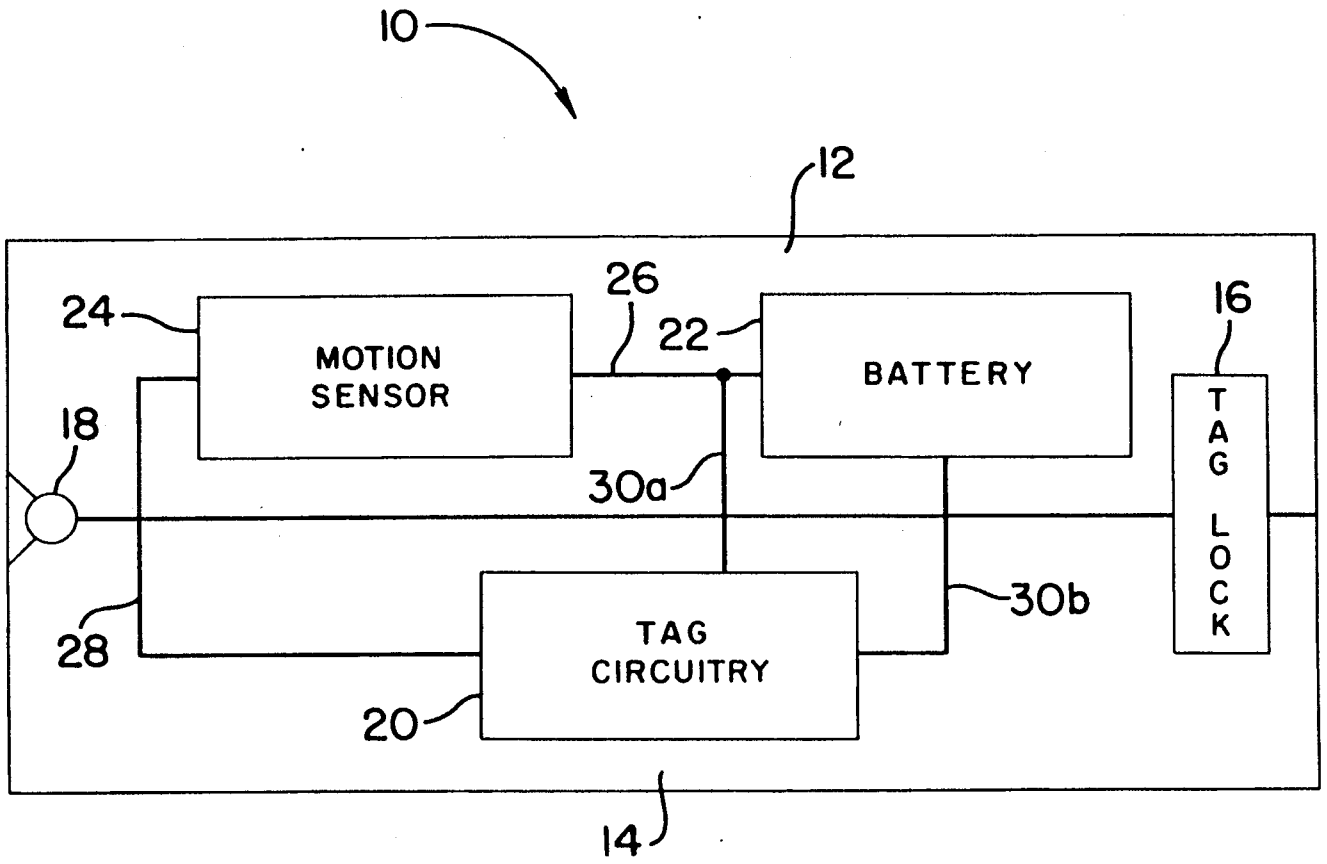
FIG. 1 is a schematic view of an EAS tag configured in accordance with the invention.

Referring to FIG. 1, EAS tag 10 includes mating housing members 12 and 14 having a jointly arranged locking mechanism 16 and pivotable about hinge 18. A receiver-reradiator member 20 and associated active electronics, per the '513 patent, are supported in housing member 14. A battery 22 is supported in housing member 12 and motion sensor 24 is connected with a terminal of battery 22 by conductor 26, conductor 28 extending from motion sensor 24 to circuitry 20. Lines 30*a* and 30*b* extend from battery 22 to circuitry 20.

In the course of movement or reorientation of the tag, motion sensor 24 provides electrical continuity therethrough and thereupon applies a voltage step, e.g., low (ground potential) to high (battery 22 terminal voltage) or vice versa, to circuitry 20 which incorporates, in addition to the active tag circuitry of the '513 patent, the detection system of FIG. 8, discussed hereinafter.

Figure 2:
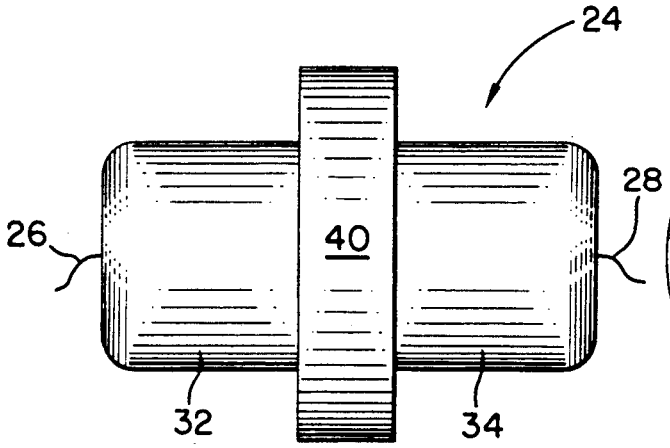
FIG. 2 is a side elevational view of a motion sensor constructed in accordance with the invention.
Figure 3:
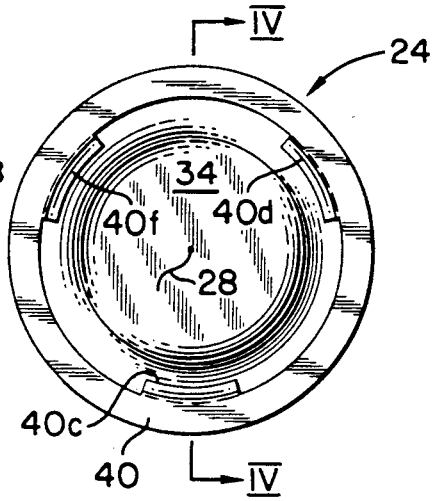
FIG. 3 is an end elevational view of the motion sensor of FIG. 1.
Figure 4:
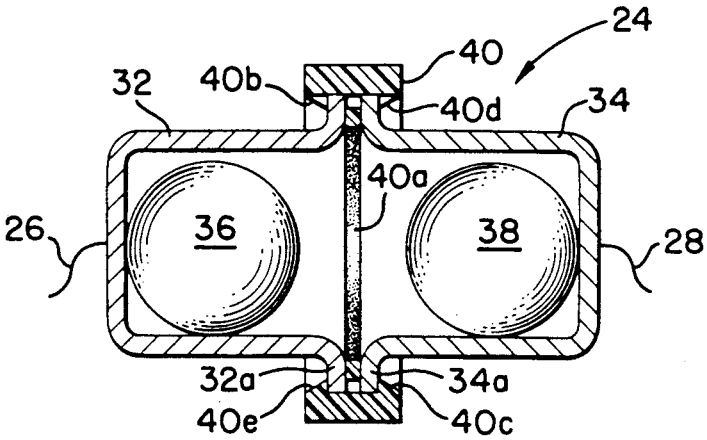
FIG. 4 is a sectional view as would be seen from plane IV—IV of FIG. 3, with the electrically conductive elements shown without sectioning and in mutually spaced relation.

Referring now to FIGS. 2–4, motion sensor 24 will be seen to include first and second housings 32 and 34, each comprised of electrically conductive material and being preferably in the form of a hollow, cup-shaped device. First and second electrically conductive elements 36 and 38, which are desirably metal spheres, are disposed respectively in the first and second housings to be highly mobile therein. A joinder member 40 interconnects the first and second housings and is comprised of electrically insulative material, defining a central passage permitting movement of spheres 36 and 38 between the first and second housings responsively to orientation of the tag.

The joinder member, the housings and the first and second electrically conductive elements are collectively dimensioned, as discussed in detail below, to provide for electrical conductivity between the first and second housings upon reorientation of the tag from disposition wherein neither of spheres 36 and 38 are in registry with the joinder member. The latter disposition is seen in FIG. 4, which also shows member 40 to have an interior, circularly continuous rib 40*a* against which flanges 32*a* and 34*a* of housings 32 and 34 abut on assembly, the rib electrically insulating the housings from one another. As is also seen in FIGS. 3 and 4, joinder member 40 includes circularly extending, mutually spaced locking tabs, shown at 40*b*, 40*c*, 40*d* and 40*e*, which secure the assembly.

Figure 5:
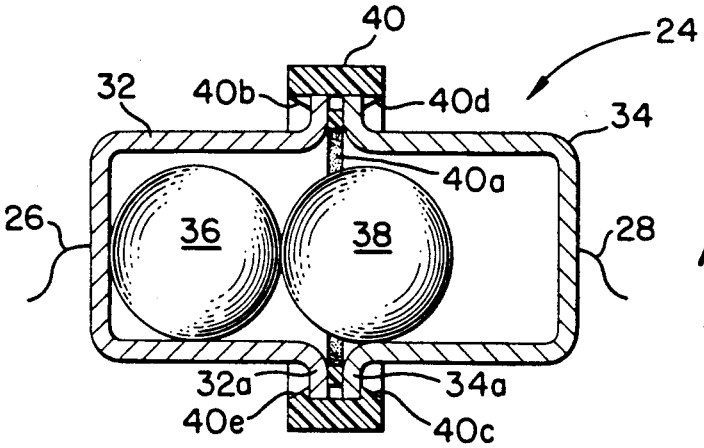
FIG. 5 is a sectional view as would be seen from plane IV—IV of FIG. 3, with the electrically conductive elements shown without sectioning and in contiguous relation.

Turning to FIG. 5, motion sensor is shown in a second disposition, wherein spheres 36 and 38 are in contiguous relation, sphere 38 having rolled into engagement with sphere 36, based on movement of the motion sensor. Sphere 38 is thus in registry with rib 40*a*, and the sphere diameters and the dimension of rib 40*a* longitudinally of the movement passage are selected to insure that sphere 38 retains electrical engagement with housing 34 when in engagement with sphere 36 and conversely for movement of sphere 36 into engagement with sphere 38. This event gives rise to electrical continuity between conductor 28, connected to housing 34 and conductor 26 connected to housing 32. The conductive path is thus from conductor 26, through housing 32, through spheres 36 and 38, through housing 34 and to conductor 28.

Figure 6:
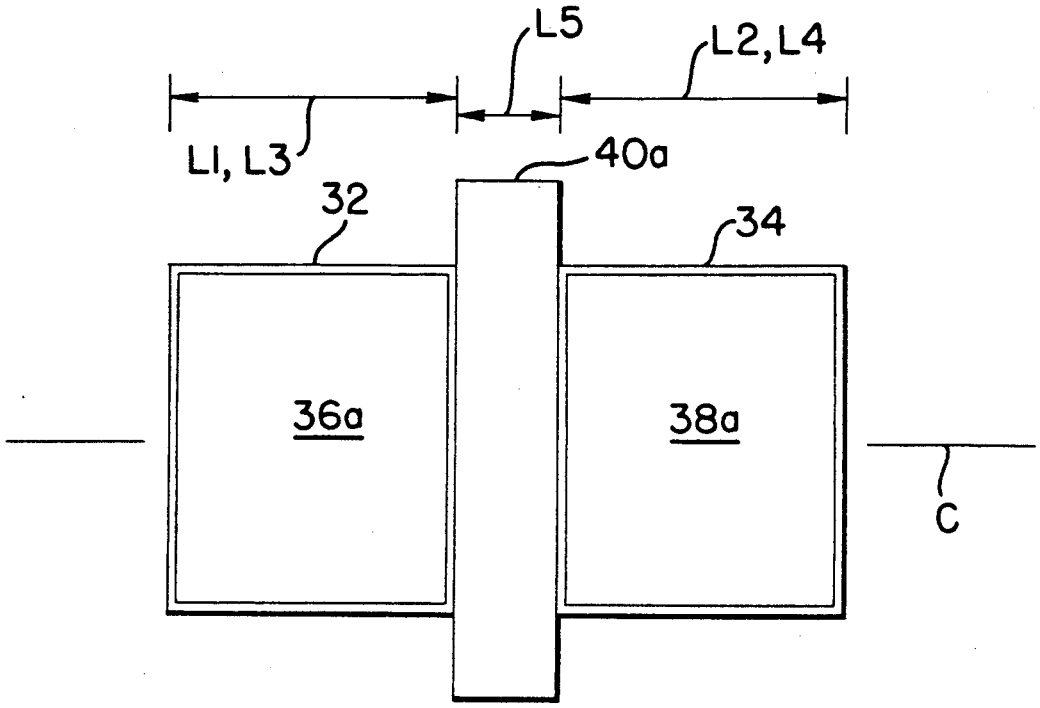
FIGS. 6 and 7 are schematic illustrations which further explain the subject invention.
Figure 7:
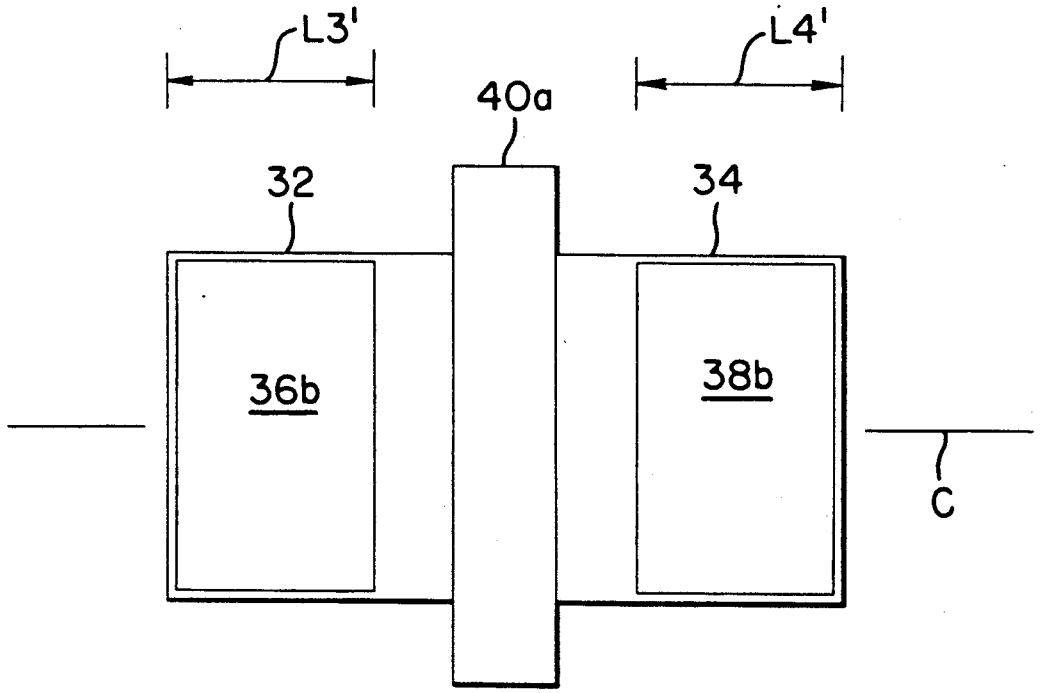

As for the above noted collective dimensioning of the components of the motion sensor, reference is now made to the schematic showings of FIGS. 6 and 7. The motion sensor is elongate, with central, longitudinal axis C.

In the FIG. 6 showing, the electrically conductive elements are indicated as blocks 36*a* and 38*a* and various dimensions are indicated. Equal lengths L1 and L2 apply to the housings 32 and 34. Lengths L3 and L4 apply to blocks 36*a* and 38*a* and are shown as essentially equal to lengths L1 and L2. Length L5 is the dimension of rib 40*a* along axis C. Given the equality among L1, L3 and L2, L4, the collective dimensioning of components in the FIG. 6 showing, for operativeness of the motion sensor, is simply that each of L3 and L4 exceed L5. This assures that, on motion to which the motion detection is sensitive, one or the other of blocks 36*a* and 38*a* will span rib 40*a* and yet retain electrical connection with its housing when engaging the other block.

In the FIG. 7 showing, lengths L3′ and L4′ of blocks 36*b* and 38*b* are shown as equal and less than lengths L1 and L2 as is the case with the spherical elements of the preferred embodiment discussed above. Here, for operativeness of the motion sensor, the sum of lengths L3′ and L4′ need exceed the sum of lengths L1 and L5 and also need exceed the sum of lengths L2 and L5.

Figure 8:
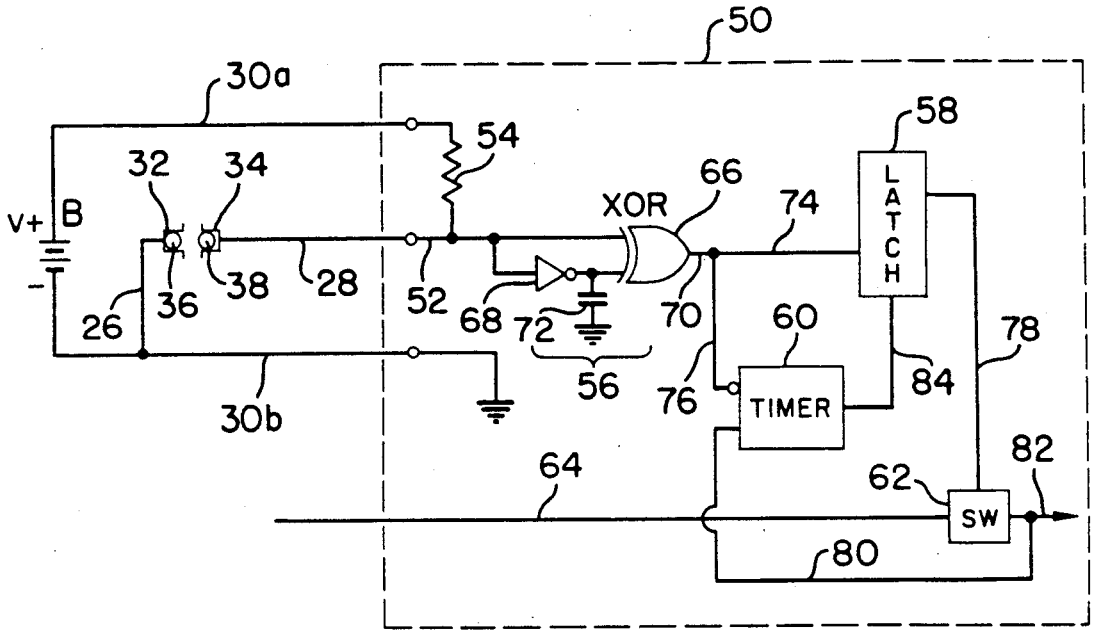
FIG. 8 is block diagram of a system usable with the subject motion sensor for detecting motion as sensed by the motion sensor.
Figure 9:
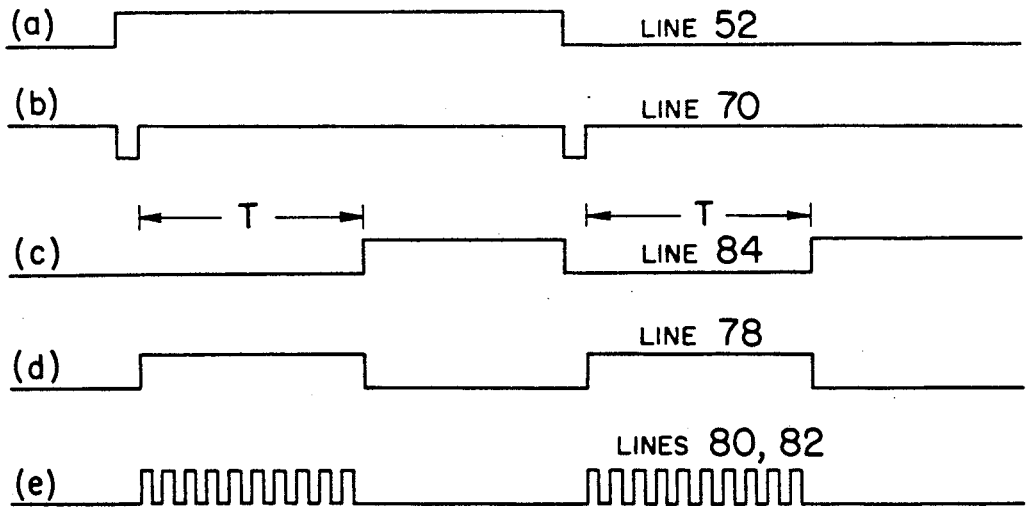
FIG. 9 is a timing diagram explanatory of the FIG. 8 system.

Turning to FIGS. 8 and 9, system 50 is used to detect the movement of the electrically conductive elements sensed by the motion sensor. Housing 32 of the motion sensor is electrically connected by line 26 to the negative terminal of battery B, which terminal is the ground reference in the system. Housing 34 is electrically connected by line 28 to input line 52 of system 50. When the elements 36 and 38 are making contact with one another, input line 52 is electrically connected to the negative terminal of the battery. When the elements are separated, the line 52 voltage level is pulled up to the battery voltage V+ through resistor 54, the resistance value of which is very large so that the current through the resistor is minimized when line 52 is grounded.

When the motion sensor is at rest, elements 36 and 38 will be stationary and will either be in contact or be separated from one another. Therefore, input line 52 will be at a constant voltage level (ground or V+). When there is movement, the elements will be in random motion, sometimes making contact and sometimes separated. This will cause line 52 to toggle between V+ and ground. The system includes for motion detection a transition detector 56, a latch 58, a timer 60 and an analog switch 62. The system is furnished with clock pulses over line 64 from a suitable clock pulse generator or crystal (not shown).

Transition detector 56 is operative to sense a change in voltage level on input line 52, either from ground to V+ or from V+ to ground. When there is no motion, the inputs to exclusive OR (XOR) gate 66 will be at opposite logic levels. If the upper input is high (logic 1), the lower input will be low (logic 0) and vice versa, since the lower input is connected to the upper input by an inverter 68. The following truth table applies.

| STATE | UPPER INPUT | LOWER INPUT | OUTPUT |
|---|---|---|---|
| 1 | 0 | 0 | 0 |
| 2 | 0 | 1 | 1 |
| 3 | 1 | 0 | 1 |
| 4 | 1 | 1 | 0 |

From the table, it can be seen that both states 2 and 3 will cause the detector 56 output to be high. When line 52 changes voltage level, the inputs to gate 66 will be at the same logic level for a short period of time (states 1 or 4). While the inputs are in this state, the output of detector 56 will go low. This creates a pulse on output line 70 of the detector on both positive and negative transitions of line 52. The pulse width is determined by the propagation delay of inverter 68 and the charge time of capacitor 72. The timing of this pulse is shown in FIG. 9, parts (a) and (b).

The detector 56 output is applied over lines 74 and 76 respectively to latch 58 and timer 60. When the detector output goes low, as is seen in part (b) of FIG. 9, it resets the timer, causing the output of the timer on line 84 to go low for a preselected time period T, as is shown in part (c) of FIG. 9. The detector output also provides a clock signal on line 74 for latch 58. On the positive edge of the pulse, the output of the latch will go high, as is seen in part (d) of FIG. 9. The output of the latch provides a control signal on line 78 for analog switch (SW) 62. When the latch 58 output goes high, analog switch 62 is enabled. This event passes the clock input on line 64 through the switch to the timer over line 80 and to other circuitry (the active tag circuitry) over line 82. This event is seen in part (e) of FIG. 9.

Once the clock input is applied to the timer, the timer begins to count. If another pulse is thereafter generated by transition detector 56, the timer will be reset and will restart its count, as is the case in the showing of FIG. 9. If there is no motion for the time period set, the timer will overflow, causing the output of the timer to go high. This resets the latch and causes the output of the latch to go low. Once the output of the latch goes low, the analog switch is disabled and this event disconnects the clock input from the timer and the active tag circuitry. Where that circuitry is CMOS, its current consumption is directly proportional to the clock frequency on line 82. The invention, by disabling the clock, substantially reduces battery loading. A substantially greater life expectancy is thus afforded by apparatus of the invention.

Evidently, where there is the condition of continuing resetting of the timer, motion being sustained, the active circuitry of the tag is enabled to receive and decode incident messages, such as is disclosed in the '513 patent.

By way of summary, the invention will be seen to provide an EAS tag inclusive of an electrical power source contained with the tag and circuitry powered by the electrical power source and a motion sensor operatively associated with the tag and contained therewith, the motion sensor providing output indication of movement and thereupon effecting loading of the the electrical power source by such tag circuitry.

The motion sensor comprises first and second housings of electrically conductive material, first and second electrically conductive elements movably supported respectively in the first and second housings, and a joinder member for mechanical interconnection of the first and second housings, the joinder member being comprised of electrically insulative material to electrically isolate the housings from one another and defining a passage permitting movement of the first and second electrically conductive means between the first and second housings responsively to orientation of the tag. The joinder member, the housings and the first and second electrically conductive elements are collectively dimensioned to provide for electrical conductivity between the first and second housings upon reorientation of the tag from a disposition wherein neither of the first and second electrically conductive elements is in registry with the joinder member to other disposition.

The detection circuitry will be seen to include a detector unit connected to one of the housings to selectively generate an output signal indicative of motion of the apparatus, a switch operative on such detection means output signal generation to conduct clock pulses therethrough to the other circuitry, and a timer advanced by the clock pulses conducted through the switch. The timer has a predetermined pulse count capacity and is connected to the detection unit to receive the detection unit output signal and to thereby be reset to zero count. The timer is operative to render the switch inoperative to conduct clock pulses therethrough on counting pulses in excess of the predetermined count capacity thereof. A latch is connected to the detection unit to receive the detection unit output signal, the latch thereupon rendering the switch operative to conduct the clock pulses therethrough. The latch is connected to the timer to receive indication therefrom of the counting of pulses in excess of the predetermined count capacity thereof, the latch being connected to the switch to render the switch inoperative to conduct the clock pulses therethrough upon receiving such excess count indication from the timer.

As contrasted with unsealed sensors of the prior art with attendant ingress of contaminants, joinder member 40 is configured as shown as a snap ring tightly engaging the cup housing members.

Further, a high degree of mobility if afforded spheres 36 and 38 in the passage collectively defined by the housings and the joinder member.

Various changes may evidently be introduced in the foregoing structure without departing from the invention. For example, the number of spheres employed may be of number exceeding the two spheres in the preferred embodiment. Thus, the particularly described and preferred embodiment is intended to be illustrative and not limiting of the invention. The true spirit and scope of the invention is set forth in the appended claims.

What is claimed is:

1. In combination:

(a) an EAS tag inclusive of an electrical power source contained with said tag and circuitry powered by said electrical power source; and (b) a motion sensor operatively associated with said tag and contained therewith, said motion sensor being connected electrically between said electrical power source and such tag circuitry, said motion sensor comprising I. first and second housings comprised of electrically conductive material, II. first and second electrically conductive means movably supported respectively in said first and second housings, and III. joinder means for interconnection of said first and second housings, said joinder means being comprised of electrically insulative material and defining a passage permitting movement of said first and second electrically conductive means between said first and second housings responsively to orientation of said tag, said joinder means, said first and second housings and said first and second electrically conductive means being collectively dimensioned to provide for electrical conductivity between said first and second housings upon reorientation of said tag from disposition wherein neither of said first and second electrically conductive means are in registry with said joinder means.

2. The invention claimed in claim 1 wherein said electrically conductive means are constituted by respective spherical members.

3. The invention claimed in claim 1 wherein said first and second housings are constituted by respective cup-shaped metallic housings.

4. The invention claimed in claim 3 wherein said joinder means is configured as a snap ring having an interior circular rib, said cup-shaped metallic housings being retained by said snap ring with said rib thereof abuttingly engaging said housings and electrically insulating said housings from one another.

5. The invention claimed in claim 4 wherein said housings define respective end flanges, said snap ring including circularly spaced locking tab means in retaining relation with said housing flanges.

6. In combination:

(a) an EAS tag inclusive of an electrical power source contained with said tag and circuitry powered by said electrical power source; and (b) a motion sensor operatively associated with said tag and contained therewith, said motion sensor being connected electrically between said electrical power source and such tag circuitry, said motion sensor comprising I. first and second elongate housings comprised of electrically conductive materials and having respective first and second lengths along a longitudinal axis common thereto, II. first and second electrically conductive means movably supported respectively in said first and second housings, and having respective third and fourth lengths along said longitudinal axis, and III. joinder means for interconnection of said first and second housings, said joinder means being comprised of electrically insulative material, defining a passage permitting movement of said first and second electrically conductive means between said first and second housings responsively to orientation of said motion sensor, said joinder means having a fifth length along said longitudinal axis, the sum of said third and fourth lengths exceeding both the sum of said first and fifth lengths and the sum of said second and fifth lengths.

7. The invention claimed in claim 6 wherein said electrically conductive means are constituted by respective spherical members.

8. The invention claimed in claim 6 wherein said first and second housings are constituted by respective cup-shaped metallic housings.

9. The invention claimed in claim 8 wherein said joinder means is configured as a snap ring having an interior circular rib, said cup-shaped metallic housings being retained by said snap ring with said rib thereof abuttingly engaging said housings and electrically insulating said housings from one another.

10. The invention claimed in claim 9 wherein said housings define respective end flanges, said snap ring including circularly spaced locking tab means in retaining relation with said housing flanges.

11. In combination:

(a) an EAS tag inclusive of an electrical power source contained with said tag and circuitry powered by said electrical power source; and (b) a motion sensor operatively associated with said tag and contained therewith, said motion sensor being connected electrically between said electrical power source and such tag circuitry, said motion sensor comprising I. first and second elongate housings comprised of electrically conductive materials and having respective first and second lengths along a longitudinal axis common thereto, II. first and second electrically conductive means movably supported respectively in said first and second housings, and having respective lengths substantially equal to said first and second lengths, and III. joinder means for interconnection of said first and second housings, said joinder means being comprised of electrically insulative material, defining a passage permitting movement of said first and second electrically conductive means between said first and second housings responsively to orientation of said motion sensor, said joinder means having a third length along said longitudinal axis, the sum of said first and second lengths exceeding both the sum of said first and third lengths and the sum of said second and third lengths 12. The invention claimed in claim 11 wherein said electrically conductive means are constituted by respective spherical members.

13. The invention claimed in claim 11 wherein said first and second housings are constituted by respective cup-shaped metallic housings.

14. The invention claimed in claim 13 wherein said joinder means is configured as a snap ring having an interior circular rib, said cup-shaped metallic housings being retained by said snap ring with said rib thereof abuttingly engaging said housings and electrically insulating said housings from one another.

15. The invention claimed in claim 14 wherein said housings define respective end flanges, said snap ring including circularly spaced locking tab means in retaining relation with said housing flanges.

16. In combination:

(a) an EAS tag inclusive of an electrical power source contained with said tag and circuitry powered by said electrical power source; and (b) a motion sensor operatively associated with said tag and contained therewith, said motion sensor being connected electrically between said electrical power source and such tag circuitry, said motion sensor comprising I. first and second housings comprised of electrically conductive material, II. first and second electrically conductive means movably supported respectively in said first and second housings, and III. joinder means for interconnection of said first and second housings, said joinder means being comprised of electrically insulative material and defining a passage permitting movement of said first and second electrically conductive means between said first and second housings responsively to orientation of said motion sensor; and (c) detection circuitry having electrical connection with one of said first and second housings and responsive to said movement of said first and second electrically conductive means to provide output indication of motion of said EAS tag.

17. The invention claimed in claim 16 wherein said EAS tag further includes an electrical power source connected to one of said housings and to active circuitry of said EAS tag, said detection circuitry being operative to effect operational loading of said power supply by said active circuitry on said detection circuitry output indication and to lessen electrical power communication from said power source to said active circuitry in the absence of said detection circuitry output indication.

18. The invention claimed in claim 17 wherein said active circuitry is of CMOS character, said detection circuitry functioning to discontinue supply of clock pulses applied thereto to said active circuitry.

19. The invention claimed in claim 18 wherein said detection circuitry includes detection means connected to one of said housings to selectively generate an output signal indicative of motion of said EAS tag, switch means operative on such detection means output signal generation to conduct clock pulses therethrough to said active circuitry, and timer means advanced by said clock pulses conducted through said switch means.

20. The invention claimed in claim 19 wherein said timer means has a predetermined pulse count capacity and is connected to said detection means to receive said detection means output signal and to thereby be reset to zero count.

21. The invention claimed in claim 20 wherein said timer means is operative to render said switch means inoperative to conduct clock pulses therethrough on counting pulses in excess of said predetermined count capacity thereof.

22. The invention claimed in claim 21 further including latch means connected to said detection means to receive said detection means output signal, said latch means thereupon rendering said switch means operative to conduct said clock pulses therethrough.

23. The invention claimed in claim 22 wherein said latch means is connected to said timer means to receive indication therefrom of said counting of pulses in excess of said predetermined count capacity thereof, said latch means being connected to said switch means to render said switch means inoperative to conduct said clock pulses therethrough upon receiving such excess count indication from said timer means.

24. The invention claimed in claim 23 wherein said detection means comprises an exclusive OR gate having a first input connected to one of said housings.

25. The invention claimed in claim 24 wherein said exclusive OR gate has a second input and further including negator means connected between said first input and said second input.

26. The invention claimed in claim 25 wherein said detection means further includes a capacitor connected to the junction of said negator and said second exclusive OR gate input.

27. The invention claimed in claim 26 further including resistor means connecting said first input of said exclusive OR gate to a terminal of said power supply.

* * * * *